United States Patent [19]

Pearson

[11] 3,939,506

[45] Feb. 24, 1976

[54] ODOR CONTROL VENTILATOR

[76] Inventor: Raymond H. Pearson, 627 Sherwood Drive, Richardson, Tex. 75080

[22] Filed: Aug. 13, 1974

[21] Appl. No.: 496,954

Related U.S. Application Data

[63] Continuation-in-part of Ser. No. 434,519, Jan. 18, 1974.

[52] U.S. Cl. ..... 4/213; 4/72

[51] Int. Cl.[2] ..... E03D 9/04; A47K 13/00

[58] Field of Search ..... 4/213, 216, 167, 218, 211, 4/209, 140, 103, 105, 106, 72, 83; 200/83 V, 83 W, 83 R; 357/26

[56] References Cited

UNITED STATES PATENTS

| | | | |
|---|---|---|---|
| 2,105,794 | 1/1938 | Norris | 4/213 |
| 2,949,615 | 8/1960 | Farrell | 4/211 |
| 3,087,168 | 4/1963 | Huso | 4/213 |
| 3,192,539 | 7/1965 | Martz | 4/218 |
| 3,302,269 | 2/1967 | Cooper et al. | 200/83 R |
| 3,321,594 | 5/1967 | Reise et al. | 200/83 V X |
| 3,495,282 | 2/1970 | Taggart | 4/213 |
| 3,535,480 | 10/1970 | Bahniuk | 200/83 V |
| 3,626,554 | 12/1971 | Martz | 4/213 |
| 3,638,481 | 2/1972 | Wilner | 357/26 X |
| 3,681,790 | 8/1972 | Dooley | 4/216 |
| 3,703,010 | 11/1972 | Russell | 4/216 |
| 3,720,963 | 3/1973 | Zakaski | 4/167 |
| 3,763,505 | 10/1973 | Zimmerman | 4/213 |
| 3,824,358 | 7/1974 | Edwards et al. | 200/83 V |

*Primary Examiner*—Henry K. Artis

[57] ABSTRACT

A ventilator for toilets is disclosed which includes an exhaust conduit connected to the upper portion of a toilet water tank for withdrawing odors from the toilet bowl through the overflow pipe in the water tank and flush water distribution outlets in the toilet bowl. A fan located in the attic and resiliently suspended therein to reduce noise resulting from fan vibrations draws odor laden air from the top of the water tank and discharges the odor laden air into the attic. A special control circuit for the attic fan is connected to the bathroom light switch which requires the light switch to be turned on, off, and back on again within a predetermined time interval before the attic fan will be turned on. A pressure sensing switch is provided which cuts the fan off when the pressure in the toilet tank reaches a predetermined low level after the tank is flushed. One preferred connection of the exhaust line to the interior of the water tank makes use of the hollow rim of toilet tank cover. Another connection of the exhaust line to the interior of the water tank makes use of a gap in the seal between the water tank and its cover and a special gasket surrounding the exhaust pipe entry point and fitted between a bathroom wall and a toilet water tank and cover which are positioned adjacent the wall. Modifications of the invention include special nozzles at the entrance end of the exhaust to connect with the water tank and a decorative exhaust pipe serving the dual function of a towel rack.

12 Claims, 11 Drawing Figures

LACK
OV
.C.
F
57
58
59
MOTOR FIELD
31b
32
R1
SCR1
CR1
R2
56a
31a
MOTOR ARMATURE
56b
SCR2
R4
R5
SPEED ADJ.
CR2
R3
C1
CR3
R6
56c'
56c
C2
RELAY
56
R7
C3
CR4
R8
56c"
CR5
61
62
55
60
S

ODOR CONTROL VENTILATOR

CROSS REFERENCES TO RELATED APPLICATIONS

This application shows various modifications of the toilet deodorizer disclosed and claimed in my pending patent application Ser. No. 434,519, filed Jan. 18, 1974, and is a continuation-in-part thereof.

BACKGROUND OF THE INVENTION

1. Field of the Invention

The invention relates to improvements in the art of toilet deodorizers and particularly to those deodorizers which include an electric motor driven exhaust fan which is connected to the inside of a toilet bowl through an exhaust conduit connected to the top of a closed water tank, and through the overflow pipe within the tank and water distribution conduit feeding from the tank into the toilet bowl.

2. Description of the Prior Art

Representative examples of the prior art of which the applicant is aware are the following patents:

| | | |
|---|---|---|
| 3,087,168 | Huso | 4-30-63 |
| 3,192,539 | Martz | 7-6-65 |
| 3,626,554 | Martz | 12-14-71 |
| 3,691,568 | Martz | 9-19-72 |
| 3,703,010 | Russell | 11-21-72 |

The above listed patents relate to toilet ventilators of the same general type to which the present invention pertains, namely, ventilators including an electric motor driven exhaust fan which is connected by a conduit to the chamber at the top of a water tank between a cover for the tank and the surface of the water within the tank. The fan applies suction to the conduit and creates a vacuum within the chamber. Odor laden air within the toilet bowl to which the water tank is connected by a water distribution conduit is withdrawn from the toilet bowl through a water overflow pipe within the water tank and the water distribution conduit to which the overflow pipe connects beneath the ball flush valve normally included within the tank.

It is an object of the invention to provide improvements in the means for connecting the exhaust conduit on the suction side of the fan to the chamber at the top of the water tank between the cover and the top of the water.

It is another object of this invention to make use of the hollow rim of a water tank cover as the passage for odor laden air from within the tank to the exhaust conduit connected to an aperture into the hollow rim.

It is another object of the invention to provide a special control circuit for the electric fan motor which includes means which permits the fan motor to operate upon the turning on, off and on again of the bathroom light switch in predetermined timed sequence.

It is a further object of the invention to provide a pressure sensing switch in the motor control circuit which cuts the fan motor off when a predetermined low pressure is reached after the toilet is flushed.

It is a further object of the invention to provide a decorative exhaust conduit between an attic exhaust fan and the water tank serves also as a towel rack.

It is a further object of this invention to provide rapid stopping of the electrically operated suction device when the toilet is flushed.

BRIEF DESCRIPTION OF THE DRAWINGS

With the foregoing objects and features in view and such other objects and features which may become apparent as this specification proceeds, the invention will be understood from the following description taken in conjunction with the accompanying drawings in which like characters of reference are used to designate like parts, and in which.

DESCRIPTION OF THE PREFERRED EMBODIMENTS

Figure 1:
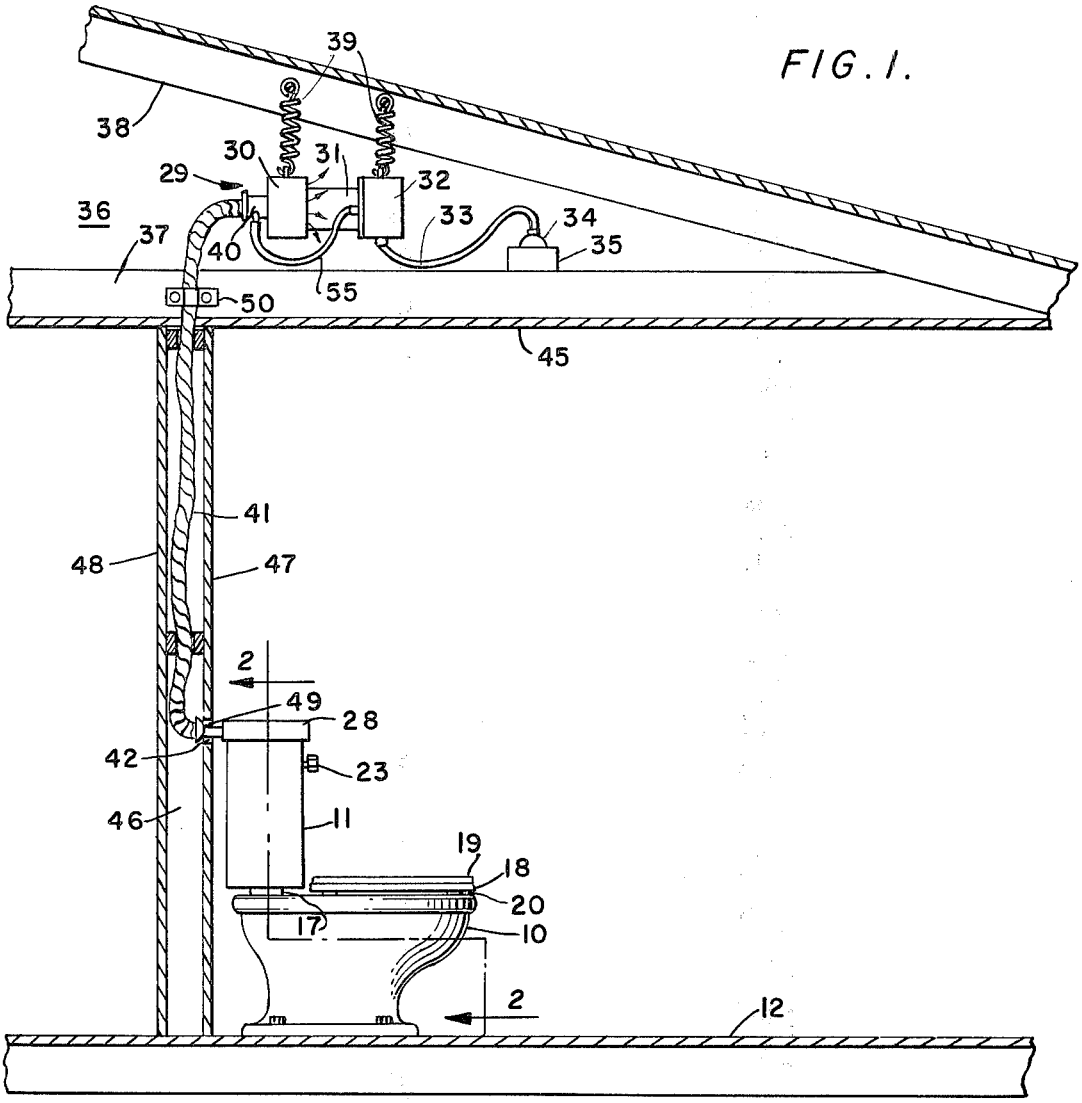
FIG. 1 is a side elevational view, shown partially in section, of the bathroom ventilator of this invention in which the exhaust fan is located in the attic above the bathroom ceiling.
Figure 2:
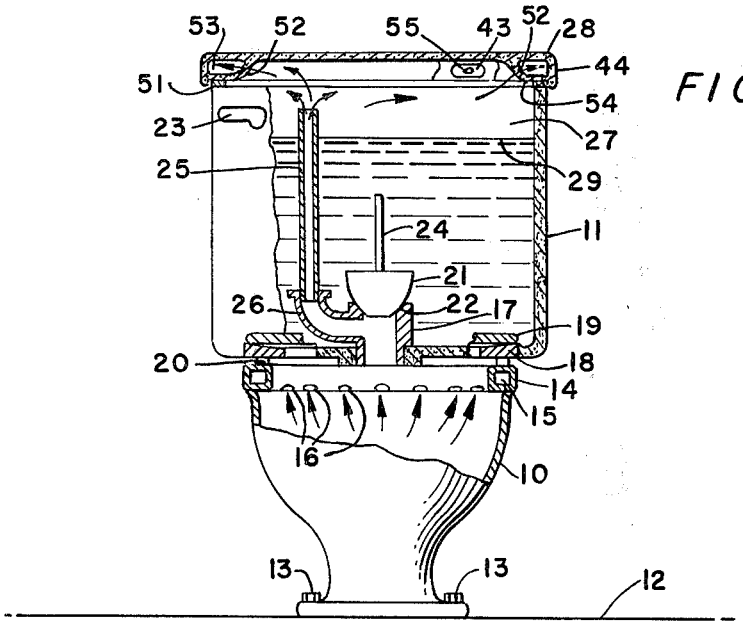
FIG. 2 is a front elevational view of the toilet below and water tank shown in FIG. 1 with a portion of the bowl and tank shown in vertical cross section taken along the line 2—2 in FIG. 1.

Referring to the drawings in detail and particularly to FIGS. 1 and 2 there is illustrated a toilet ventilator which is adapted to be used in conjunction with a conventional water closet including a bowl 10 and a water tank 11. The toilet bowl 10 is conventionally bolted to a bathroom floor by bolts 13. The top of the toilet bowl 10 includes a hollow rim 14 which defines an annular chamber 15 for distribution of water through holes 16 distributed about the bottom inside edge of the hollow rim. The water tank 11 is seated on the rear of the bowl 10 and is connected by means of a pipe 17 to a mating aperture (not shown) in the hollow rim 14. In front of the water tank 11 are provided the usual toilet seat 18 and seat cover 19. The customary cushion members 20 are attached on the underside of the seat 18 to separate the bottom of the seat from the top of the toilet rim 14. Inside the water tank 11 are provided the customary fittings (for clarity only partially shown) including a bulb valve 21 which is normally seated on the valve seat 22 at the upper end of the flush pipe 17. The bulb valve 21 is adapted to be lifted upon manual operation of the flushing handle 23 which is operatively connected by conventional linkages (not shown) with the valve stem 24. An overflow pipe 25 extends from a branch line 26 connected to the flush pipe 17 beneath the bulb valve to the chamber 27 at the top of the tank between the tank cover 28 and the normal water level 29 within the tank prior to flushings. It will be understood that the water tank also includes the usual inlet pipe, inlet valve, float and connecting linkage for operating the inlet valve in response to the level of water in the water tank.

The ventilator of the preferred embodiment includes an electrically operated suction device 29 comprising a centrifugal blower, or fan 30, an electric motor 31, and a control package 32. The control package 32 is electrically connected by an insulated cable 33 and plug 34 to an electrical supply receptacle 35 mounted on the ceiling joists 37 in the attic 36 of a building structure in which the toilet is located. The electrically driven suction device 29 is resiliently supported from a rafter 38 in the attic 36 by means of coil springs 39 in order to reduce the noise caused by motor and fan vibrations. The inlet side 40 of the fan 30 is connected via a flexible conduit 41 and nozzle 42 to an aperture 43 provided in the hollow rim 44 of the tank cover 28. The flexible conduit 41 extends down through the ceiling 45 and the space 46 between vertical wall surfaces 47 and 48 to the rear of the toilet tank. An aperture 49 is provided in the wall surface 47 through which the nozzle 42, attached to the inlet end of the conduit 41, extends. A clamp 50 is provided to secure the upper portion of the conduit 41 to the ceiling joist 37.

Returning to the water tank 11 it will be noted that a gasket 51 is provided between the underside of the cover 28 and the top edge of the water tank to form an air tight seal. The hollow rim 44 in the tank cover 28 forms an annular air channel 53 which is connected by a plurality of spaced apertures 52 through the inner wall 54 with the chamber 27. In as much as at least some water tank covers commercially available are provided with a hollow rim 44 extending continuously around the cover, it is merely necessary in order to adapt a commercial cover to this invention to drill a more or less oval hole 43 from the outside through the rear of the cover 28 and to drill one or more holes 52 on the inside of the cover through the inside wall 54. Sanitary ware for toilets is usually quite hard, therefore a diamond drill and router are required to make the holes. The hole 43 is preferably drilled near one end of the cover in order not to structurally weaken the cover. Although one or two large holes 52 will handle the air flow from the chamber 27 through the cover, several small holes are better because the hollow cavity 53 within the cover then becomes a low-pass acoustical filter which attenuates the sound of air flow into the cavity.

When the suction device 29 is operating, odor laden air is pulled into the existing holes 16 in the bowl 10 through the channel 15, through the pipe 17, through the overflow pipe 25, through the holes 52 and channel 53, through the hole 43 and nozzle 42, through the flexible conduit 41, through the centrifugal blower 30, and into the attic where it is dispersed.

The air duct 41 is preferably of the type comprised of a very thin plastic tube reinforced by an internal wire helix. A satisfactory type is the General Tire and Rubber Company "Gen-Line Air Ducting 901" with a one inch inside diameter. This is a very light and flexible ducting which can readily withstand the vacuum encountered. The nozzle 42 is preferably of thin neoprene tubing which is attached to the air duct 41 on one end, and is slightly oval-shaped on the other end due to a thin oval metal insert. It fits the hole 43 closely so as not to leak air.

The gasket 51 is preferably a flexible and resilient foam material such as rubber or an elastomeric synthetic resin since it is required to conform to any irregularities in the bottom edge of the cover 28 on the top edge of the tank 11. A seal is normally not required between the toilet seat 18 and the bowl 10 because of the efficient air flow in the present system. This is an advantage of the present system.

Figure 3:
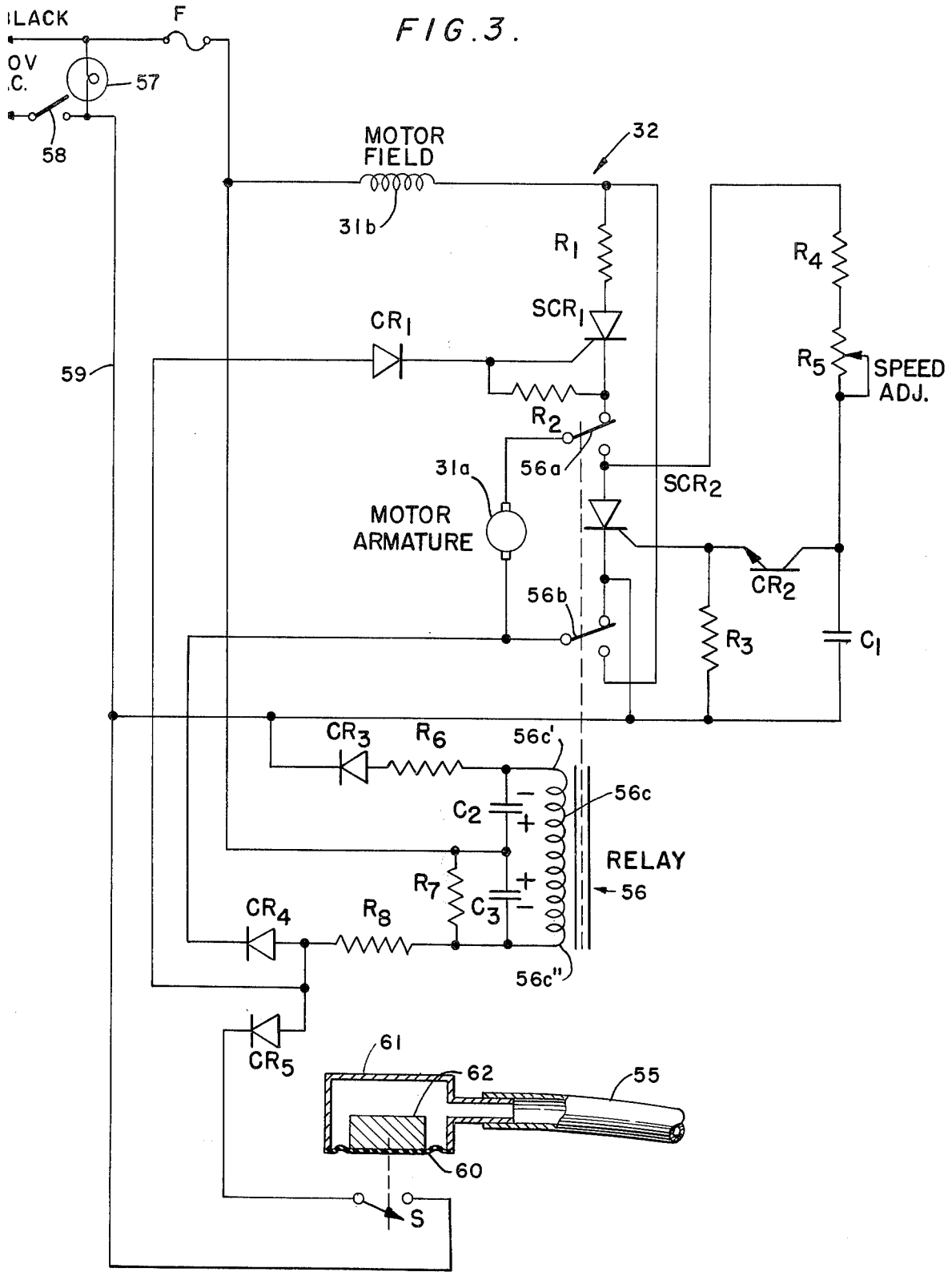
FIG. 3 is a schematic diagram of the electrical control circuits for operating the ventilator exhaust fan used in this invention.

FIG. 3 portrays a suitable schematic diagram for the electronics control package 32. Briefly, the purpose of this control package 32 is to provide starting, stopping and speed control for the suction motor 31. The motor 31 is of the usual AC-DC universal type, as commonly employed in vacuum cleaners. Thyristor $SCR_2$, trigger diode $CR_2$, resistors $R_3$, $R_4$, and $R_5$ (the speed adjust control), and capacitor $C_1$ comprise an adjustable speed regulator. $R_5$ is normally adjusted so as to provide a suction of about two inches of water inside the tank cavity 27. This amount of vacuum will cause a substantial flow of air through the ventilator system. The tank pressure can be conveniently measured by disconnecting the pressure sensing tube 55 from the electronics package 32, and connecting it to a manometer (not shown). The pressure sensing tube 55 is a small plastic tube which is coaxial with the air duct 41, passing through nozzle 42 into the cover 28 about an inch or so. It accurately senses the pressure in the tank cavity 27. The relay 56 together with rectifiers $CR_3$ $CR_4$, resistors $R_7$,$R_8$, and $R_6$, and capacitors $C_2$ and $C_3$ comprise the normal starting circuit. It will be observed that the usual electronics package 32 connects to the wiring for the bathroom lamp 57. This is more economical than providing a separate circuit and switch for the system. When the bathroom lamp switch 58 is turned ON the relay 56 remains deenergized, because both sides of the relay coil **56*c* return to the white wire 59. The top side 56*c*′ returns to the white wire 59 through resistor $R_6$ and rectifier $CR_3$, and the bottom side 56*c*″ returns through resistor $R_8$, rectifier $CR_4$, and one pole 56*b* of the relay as shown. Thus the bathroom lamp 57 may be used in normal fashion without the deodorizer turning ON. Capacitors $C_2$ and $C_3$ are charged in the indicated polarity any time the bathroom lamp switch 58 is turned ON. When the lamp switch 58 is turned OFF, capacitor $C_3$ is quickly discharged through resistor $R_7$, and capacitor $C_2$ discharges slowly through the high resistance relay coil 56*c* together with resistor $R_7$. The flow of current from capacitor $C_2$ through the relay coil 56*c* causes the relay to energize for about one second, or until $C_2$ is discharged. If during the one second interval when the relay 56 is deenergized the lamp switch 58 is turned back ON again, the motor 31 will start. Thus to start the deodorizer blower 30, the lamp switch 58 is given an ON-OFF-ON sequence, or if the lamp is already ON, an OFF-ON sequence will suffice. The deodorizer blower 30 normally runs until the toilet is flushed, at which time the pressure in the tank 11 is reduced substantially because water floods the overflow pipe 25 blocking the flow of air through it. The pressure within the pressure sensing tube 55 follows the tank pressure, and therefore is also substantially reduced. Weight 62 which is bonded to the diaphragm 60 in the housing 61 of pressure switch S will be lifted by the diaphragm 60 if the tank vacuum increases beyond a predetermined value, for example, three inches of water. Thus when the toilet is flushed the weight 62 is lifted causing pressure switch S to close. This of course returns the lower side 56***c*'' of the relay coil back to the white wire 59 via resitor $R_8$ and rectifier $CR_5$, causing the relay 56 to deenergize which removes power from the motor 31. It is important that the motor stop quickly, because otherwise the normal flushing action of the toilet will be retarded due to the vacuum within tank 11. Thyristor $SCR_1$ resistors $R_1$ and $R_2$, and rectifier $CR_1$ comprise an electronic brake which stops the motor 31 very quickly. Of course the motor 31 may also be stopped by turning OFF the lamp switch 58 if the toilet is not flushed. The lamp switch 58 may also be turned back ON again after a one second interval without the deodorizer blower starting if so desired. The control circuit may be modified to accommodate a wall switch which is separate from the lamp switch 58 if so desired. This is useful if the suction device 29 must be located under the house instead of in the attic as shown in FIG. 1. Other types of electronic starting and stopping circuits may be developed by those skilled in the art. An air flow sensing switch (not shown) may be substituted for pressure switch S if so desired, since the air flow through duct 41 drops substantially when water floods the overflow pipe 25.

Figure 4:
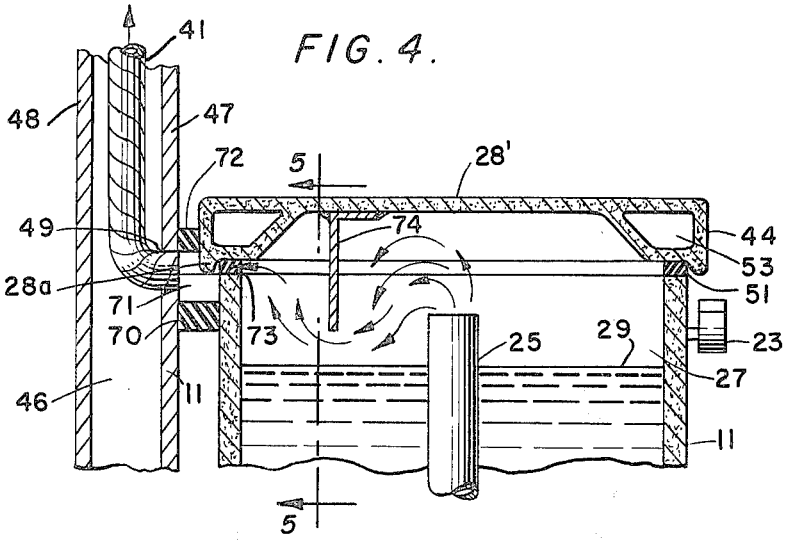
FIG. 4 is a fragmentary vertical cross sectional view of a modified form of the invention.
Figure 5:
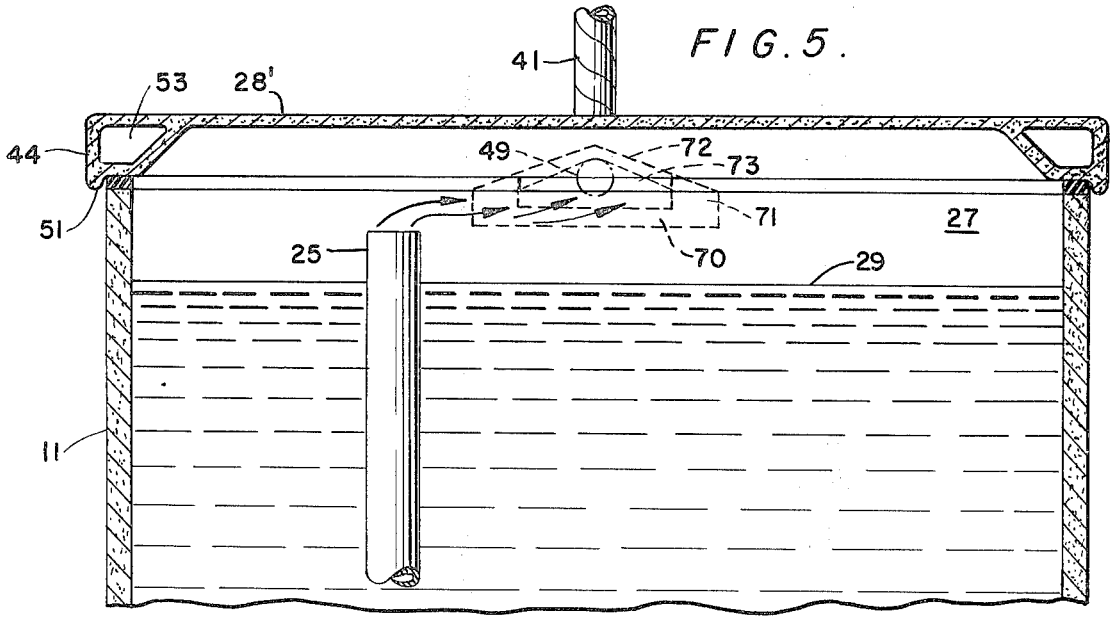
FIG. 5 is a vertical cross sectional view taken along line 5—5 of FIG. 4.
Figure 6:
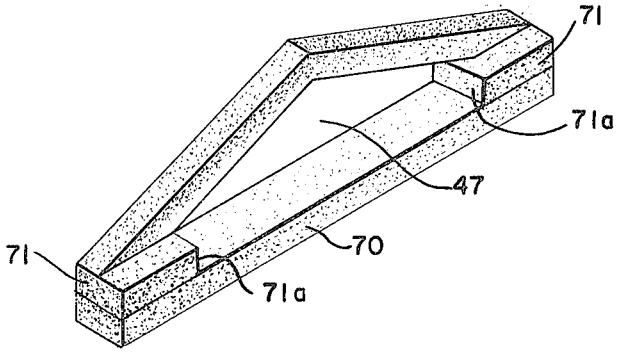
FIG. 6 is a perspective view of the seal used between the water tank and bathroom wall as shown in vertical cross section in FIG. 4.

FIGS. 4, 5 and 6 portray a modified embodiment of the invention which is useful if the tank 11 is not too close to the wall 47 and if equipment for drilling the holes 43 and 52 in the hollow rim of cover 28 shown in FIGS. 1 and 2 is not available. The air duct 41 is terminated at the opening 49 which is drilled in the wall 47 slightly above the upper edge of the tank 11 since it is difficult to drill below the edge of the tank 11 after the tank is installed. An elongated rectangular cross-sectioned seal strip 70 extends between the wall 47 and the rear of cover 28' as do the short rectangular seal sections 71 provided on top of and at opposite ends of the seal strip 70. The lower lip 28*a* of the cover 28' rests on top of the two seals 71. An arched sealing strip 72 is provided between the wall 47 and the rear of cover 28' and extends from the top of the seals 71 over top of the opening 49 in which the air duct 41 terminates. A gap 73 is provided in the gasket 51 in the area above the seals 71 between the inner ends 71*a* thereof. This gap permits odor laden air to pass through the gap 73 under the lip 28*a* of cover 28', and into the air duct 41. Foam rubber is effective for the seal 70 and strip caulking of the type used on automobiles and refrigerators is very effective material for the seals 71 and 72 since it readily conforms to the cover 28' and forms a perfect seal. A sheet metal baffle 74 depending from the underside of the cover 28' near the gap 73 prevents water from being splashed into the air passageway. The baffle 74 is L-shaped and extends from the underside of the cover 28' almost to the water line 29 in tank 11. Refrigerator caulking effectively holds the baffle 74 to the cover 28'. The baffle 74 is made a little wider than the gap 73 in the gasket 51. Upon flushing the toilet, water immediately sprays out of the overflow pipe 25, due to the slight vacuum within the tank 11 and splashes against the cover 28'. In actual tests the baffle 74 completely eliminated water being sucked into the air conduit 41. The baffle is useful in all types of deodorizers having suction lines entering the water tank 11.

It will be understood that the embodiment illustrated in FIGS. 4, 5 and 6 except for the manner of connecting the air duct 41 with the chamber 27 inside the water tank 11 is like the ventilator system illustrated in FIG. 1. The air duct 41 leads to a suction device 29 (mounted in the attic of a building) which is controlled by the system shown in FIG. 3.

Figure 7:
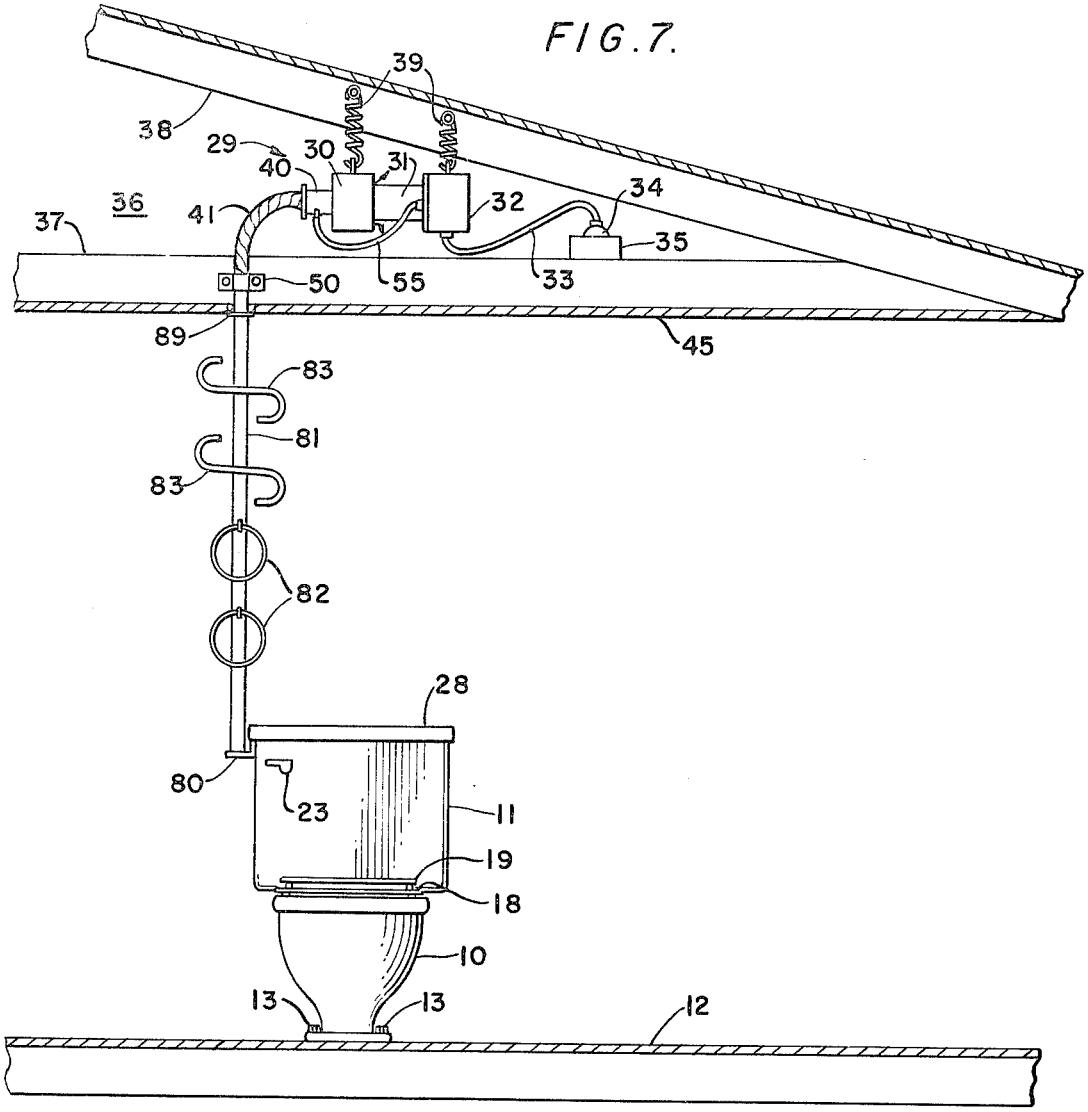
FIG. 7 is a front elevational view of a second modified form of the invention.
Figure 8:
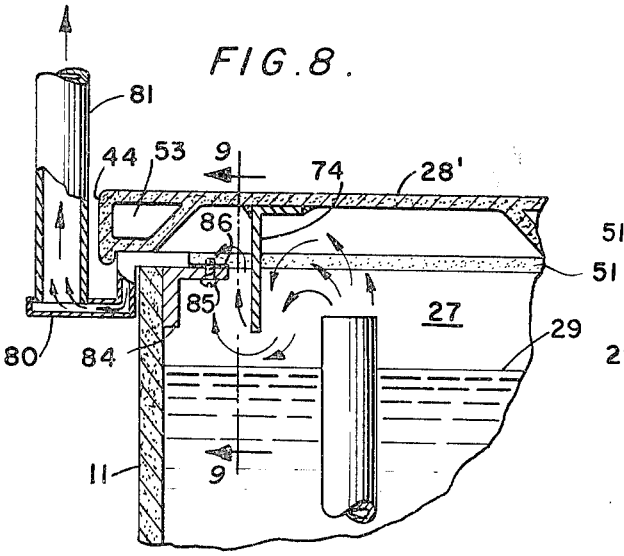
FIG. 8 is a vertical cross sectional view of the modification shown in FIG. 7, the view being taken through the upper portion of a water tank and connecting exhaust conduit.
Figure 9:
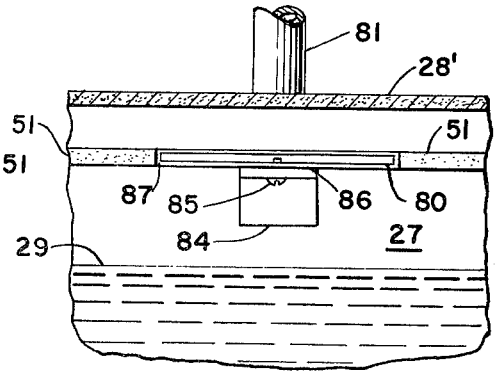
FIG. 9 is a fragmentary vertical cross sectional view taken along line 9—9 in FIG. 8.

Another useful modification of the invention is shown in FIGS. 7, 8 and 9. This modification employs a nozzle 80 of the type described in the inventor's pending application Ser. No. 434,519, together with a unique decorative tubular towel pole arrangement 81. The towel pole 81 is attached to the nozzle 80 which is clamped to tank 11 according to the aforementioned application by an adjustable angle bracket 84 secured to the nozzle extension 86 by a screw 85. The suction device 29 connects to the upper end of the towel pole 80 by means of a short air duct 41. The upper end of the towel pole 80 is secured to the ceiling joist 37 by a bracket 50, while the bottom end is supported by the nozzle 80 to which it is connected by a fluid tight joint for the passage of odor laden air through the nozzle 80 and up the tubular towel pole to the suction device 29. The towel pole 80 has decorative towel supporting attachments 82 and 83 spaced along the length. The toilet bowl 10, tank 11 and cover 28' are the same as described with reference to the embodiment shown in FIGS. 4 and 5 and need no further description. The gasket 51 between the tank cover 28' and the upper edge of the tank 11 has a gap 87 along one side of the tank which is of sufficient width to receive the horizontally elongated nozzle 80, however, the ends of the gasket on either side of the gap 87 closely fit against the sides of the nozzle 80 to provide an air tight seal. Since the embodiment shown in FIGS. 7 and 8 requires drilling only a hole 89 in the plaster or sheet rock ceiling 45 for the towel pole 80, its installation is well within the capability of the home owner. The system may be quieter and more powerful than that described in the aforesaid pending application Ser. No. 434,519 but of course cannot be moved to another house as readily. It is also more expensive. It is particularly useful in areas where professional installation is not available, and in homes where more towel space is needed, or where towel poles are not detrimental to the decor. Other types of decorative poles may be employed such as a two-pole arrangement with shelves between them. In the case of a two-pole arrangement, only one pole need be an active air duct. Furthermore, the poles may extend to the floor on either side of the tank 11, one of the poles being connected to the nozzle 80 either solidly or through a short flexible duct. Such two-pole accessaries, without deodorizer, are in common use today. A baffle 74 is desirable as described before in reference to FIGS. 4, 5 and 6. In both of the aforementioned alternate arrangements, the same suction device 29 described with reference to the preferred embodiment shown in FIG. 1 is employed.

Figure 10:
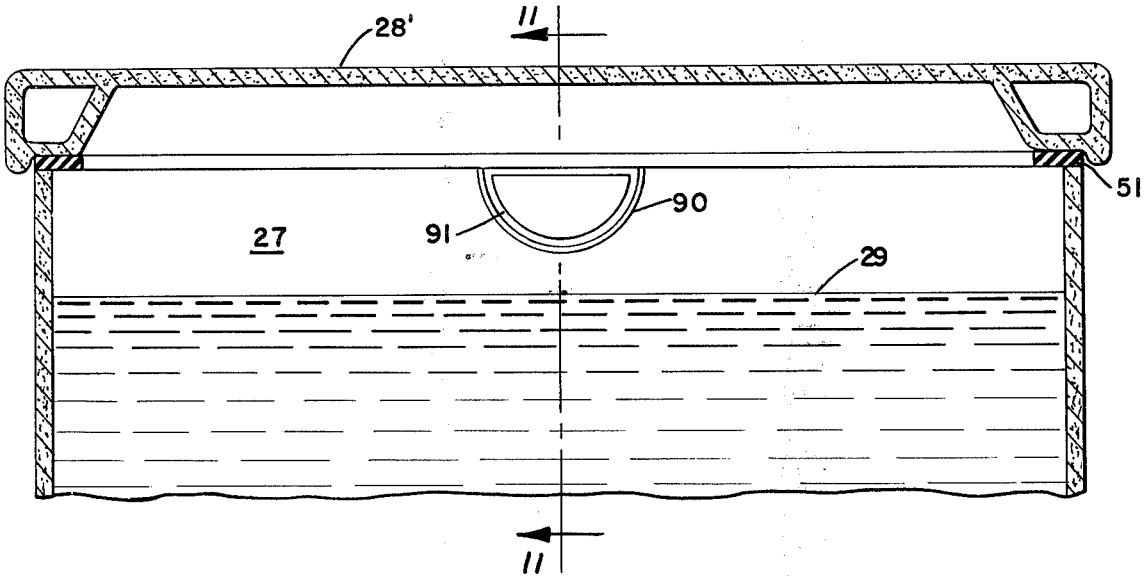
FIG. 10 is a vertical cross sectional view of the upper portion of a water tank in still another modification of the invention.
Figure 11:
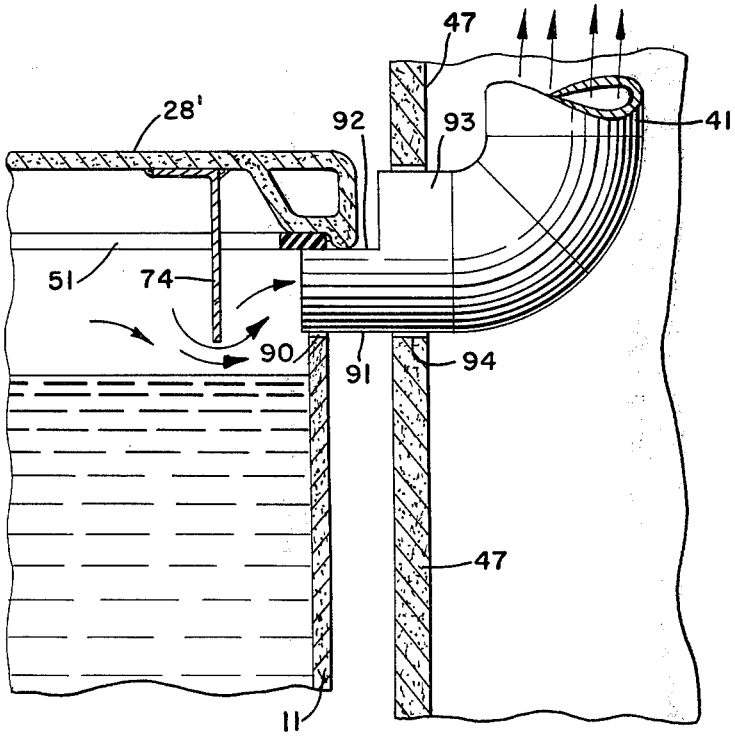
FIG. 11 is a vertical cross sectional view taken along line 11—11 of FIG. 10.

FIGS. 10 and 11 portray a modified nozzle for connecting the ventilator air duct 41 to the water tank 11 in a manner which does not require a gap in the seal 51. The problem encountered with most toilets is that they are installed with the tank 11 very near or even touching the wall 47. If a thin flat duct, such as nozzle 80 shown in FIGS. 8 and 9, capable of passing through a gap in the thin seal 51 is to be effective, it must be quite wide in order to provide the adequate cross-sectional area required if the air velocity and noise are to remain at low levels, and it must be long so that the transition from the air duct is not too abrupt. The nozzle 80 of FIG. 8 may be long enough and wide enough to be effective, but at the rear of the tank 11 there is not normally enough room for a good thin nozzle design because of the close proximity to the wall 47. The D-shaped nozzle arrangement of FIGS. 10 and 11 provides an adequate cross-sectional area resulting in a low air velocity and noise level; it is not influenced by the distance of the tank 11 from the wall 47; and it allows the use of a desirably thin and continuous seal 51. It is intended as a professionally installed accessary.

The embodiment shown in FIGS. 10 and 11 provides a more or less semicircular cutout 90 in the rear wall of tank 11. The nozzle 91 has a semicircular, or D-shaped, front portion which is disposed within the cutout 90, and its flat upper surface 92 is approximately congruent with the upper edge of the tank 11. The rear portion 93 of the nozzle 91 is ideally round so as to readily connect to the air duct 41. The front portion of the nozzle 91 which is D-shaped should be rigid so that an effective seal is provided in the cutout 90, and at its upper surface which contacts the gasket 51.

Ideally, the semicircular cutout 90 and the round hole 94 in the wall 47 are on the same centers. Thus, in forming the cutout and hole, a diamond core drill of suitable diameter is positioned with its center at or slightly above the top of tank 11. The core drill then passes through the tank 11 and wall 47, leaving the semicircular cutout 90 in tank 11, and the round hole 94 in the wall 47.

The shape of the nozzle 91 is not restricted to the preferred D-shape. Thus a square or rectangular nozzle may be used inasmuch as these shapes provide the flat top side necessary to seal upon gasket 51. Any stiff nozzle located in a cutout within tank 11, and having a flat top side congruent with the upper edge of the tank 11, is within the scope of this invention and is an improvement over the prior art. Shapes other than the semicircular D-shape will usually be much more difficult to install than the D-shape nozzle. It is to be understood that the toilet bowl 10 and tank 11 shown in FIGS. 10 and 11 are similar to the toilet bowl and tank described with reference to the preceding embodiments of this invention except for the manner of connecting the air duct 41 to the tank 11. Further the air duct 41 shown in FIG. 11 may be connected to a suction device 29 in the same manner as described with reference to FIG. 1 and therefore needs no further description.

What is claimed is:

1. A toilet deodorizing accessary for use in combination with a conventional water tank and toilet bowl, the water tank having a water discharge conduit through the bottom of the tank, a flush valve controlling the flow of water from the tank into said conduit, and an overflow pipe connected into said discharge conduit below the valve, said toilet bowl having a water distribution channel in communication with said discharge conduit for distributing water from said tank into said bowl when said flush valve is operated to flush said bowl, said accessary comprising a cover for said tank having a top wall and spaced inner and outer side walls depending from said top and integrally connected by a narrow bottom wall to form a continuous hollow passage extending peripherially beneath said top wall, a hole through said outer wall, and at least one hole through said inner wall, an electrically driven air blower, having a suction side and a discharge side, an air duct connected between said suction side and the hole in the outer side wall of said cover whereby odor laden air may be drawn by said blower in seriatim from said toilet bowl through said water distribution channel, said water discharge conduit, said overflow pipe, the hole in said inner side wall of the cover, the continuous hollow passage in said cover, the hole in said outer wall into said air duct and discharged through said blower.

2. The accessary according to claim 1 together with control means for said electrically driven air blower which means includes air sensitive means for removing electric power from the electrically driven air blower when the toilet is flushed.

3. The accessary according to claim 2 wherein said air sensitive means includes a pressure switch responsive to air pressure in said tank, said switch operating when the air pressure in said tank is reduced to a predetermined low pressure upon flushing of said toilet.

4. The accessary according to claim 2 together with means for quickly stopping said electrically driven air blower upon removal of electric power from said electrically driven air blower.

5. The accessary according to claim 1 together with control means for said electrically driven air blower, said control means including a starting circuit, an electric switch for energizing said starting circuit, and sequence detecting means within said starting circuit for starting said electrically driven air blower only after said electric switch has been operated in accordance with a predetermined time sequence of on-off operations.

6. The accessary according to claim 5 wherein said sequence detecting means will permit said starting circuit to start said electrically driven air blower only after said electric switch has been turned on, off, and back on again within a predetermined time.

7. The accessary according to claim 5 wherein said switch is a bathroom light switch.

8. A ventilator for toilets comprising the combination of a toilet bowl, a water tank for flushing the toilet bowl, the water tank having a cover, a discharge conduit extending from said tank, a flush valve controlling the flow of water from the tank into said conduit, and an overflow pipe connected into said discharge conduit below the valve, said toilet bowl having a water distribution channel in communication with said discharge conduit for distributing water from said tank into said bowl, an electrically driven suction device, means connecting said electrically driven suction device to the inside of said tank above the normal water line therein, and control means for supplying electric power to and removing electric power from said electrically driven suction device, said control means including air sensitive means responsive to air within said tank for automatically removing power from said electrically driven suction device when said flush valve is operated to flush said bowl said control means also including a starting circuit having a power control switch therein and a sequence detecting means for preventing operation of said electrically driven suction means until said power control switch has been operated in accordance with a predetermined sequence of on-off operations.

9. The ventilator according to claim 8 together with means for quickly stopping the electrically driven suction device when the electric power is removed.

10. For use in connection with the bowl and water tank of a toilet, said tank being adapted to receive odor laden air from said bowl, said tank having an air space at the upper portion thereof, a ceiling above the tank and an air space above the ceiling; a bathroom accessory comprising the combination of a towel pole and toilet ventilator, said towel pole comprising a hollow vertical tube having towel holders suitably attached thereto, the lower portion of said hollow vertical tube being operatively connected into the air space of the water tank of said toilet so as to form a substantially airtight passage from said air space into the bore of said hollow vertical tube, said hollow vertical tube or extension thereof passing through the ceiling above said toilet, air blower means operatively connected into the bore of said hollow tube or extension thereof which passes through said ceiling, whereby odor laden air may be drawn from said toilet, through the bore of said towel pole, and discharged to atmosphere, said towel pole also serving as a towel holder.

11. For use in connection with a toilet including toilet bowl provided with flushing means, and a water tank adapted to receive odor laden air therefrom, said water tank having an air space at the upper portion thereof, air blower means having a suction inlet, and an outlet discharging into the atmosphere; an improved toilet ventilator accessory comprising an air duct operatively connected into the air space within the water tank of said toilet, and also operatively connected to the suction side of said air blower means so as to reduce the air pressure within said water tank, air sensor means capable of sensing the air pressure within said water tank or the rate of air flow through said air duct, electrical switching means controlled by said air sensor means and capable of removing power from said air blower means, whereby odor laden air may be drawn in seriatim from the bowl of said toilet, through the overflow pipe of said water tank, through said air duct, and suitably discharged into the atmosphere by said blower means, and whereby the combination of said air sensor means and said switch means removes electrical power from said blower means when said toilet is flushed, said air sensor means being responsive to the sudden decrease in air pressure within said water tank or to the sudden decrease in air flow through said air duct when said toilet is flushed.

12. For use in connection with a toilet including a toilet bowl having flushing means and a water tank for supplying water to said bowl, said tank having an upper space for receiving odor laden air from the bowl, and air blower means discharging into atmosphere and having a suction inlet; an improved toilet ventilator accessory comprising an air duct suitably connected into the air space within the water tank of said toilet, said duct being also suitably connected to the suction inlet of said air blower means so as to reduce the air pressure within said water tank, electrical control means capable of removing power from said air blower means when said toilet is flushed, and braking means capable of rapidly slowing said air blower means when said toilet is flushed, whereby odor laden air may be drawn in seriatim from the bowl of said toilet, through said duct, and suitably discharged into the atmosphere by said air blower means, and whereby said braking means permits the rapid repressurization of the air within said water tank so as to allow a normal rapid flushing action.

* * * * *